United States Patent [19]

Koba

[11] Patent Number: 4,718,338

[45] Date of Patent: Jan. 12, 1988

[54] VENEER PROCESSING APPARATUS

[75] Inventor: Yoshinori Koba, Aichi, Japan

[73] Assignee: Meinan Machinery Works, Inc., Aichi, Japan

[21] Appl. No.: 893,103

[22] Filed: Aug. 4, 1986

Related U.S. Application Data

[63] Continuation-in-part of Ser. No. 791,359, Oct. 25, 1985, Pat. No. 4,691,629.

[30] Foreign Application Priority Data

Aug. 28, 1985 [JP] Japan ..... 60-189157

[51] Int. Cl.[4] ..... B30B 9/20

[52] U.S. Cl. ..... 100/121; 100/176; 29/121.6; 144/362

[58] Field of Search ..... 100/121, 98 R, 176, 100/902, 118; 29/121.1, 121.6, 121.7, 132; 144/362, 254, 255, 280

[56] References Cited

U.S. PATENT DOCUMENTS

| | | | |
|---|---|---|---|
| 128,387 | 6/1872 | Gyles | 144/362 |
| 1,517,036 | 11/1924 | Wagner | 29/121.6 |
| 1,539,338 | 5/1925 | Wagner | 100/118 X |
| 1,552,098 | 9/1925 | Wagner | 29/121.6 |
| 3,447,221 | 6/1969 | Odiorne | 29/121.6 |
| 3,472,160 | 10/1969 | Scott | 100/176 |
| 4,050,886 | 9/1977 | Moser | 29/121.6 |

FOREIGN PATENT DOCUMENTS

| | | | |
|---|---|---|---|
| 48-49905 | 7/1973 | Japan | 100/121 |
| 49-39808 | 10/1974 | Japan . | |
| 52-9721 | 3/1977 | Japan | 100/121 |
| 56-32547 | 7/1981 | Japan | 100/121 |
| 54768 | 6/1923 | Sweden | 100/118 |

*Primary Examiner*—James Kee Chi

*Attorney, Agent, or Firm*—Lahive & Cockfield

[57] ABSTRACT

A veneer processing apparatus squeezes water out of a crude veneer when the veneer is inserted into the apparatus in such an orientation that fibers thereof extending substantially parallel to an intended direction of veneer insertion, and forms short splits in the veneer when the veneer is oriented such that the fibers extend substantially perpendicular to that direction. A pair of rolls each being provided with teeth thereon are so located as to cause their teeth to become aligned with each other at a predetermined position for veneer insertion. Each teeth is indented to have alternating projections and recesses. In the position for veneer insertion, the projections of the teeth on one roll are substantially interlocked with the recesses of the teeth on the other roll or are spaced from the projections of the teeth on the latter roll by an amount which is smaller than the thickness of the veneer. The recesses are filled with sponge or like elastic material. The rolls may each be replaced with an assembly of annular roll elements coaxially mounted on a rotary shaft, or an endless belt which is passed over rollers.

9 Claims, 14 Drawing Figures

VENEER PROCESSING APPARATUS

This application is a continuation in part of U.S. patent application Ser. No. 791,359 filed Oct. 25, 1985, now U.S. Pat. No. 4,691,629.

BACKGROUND OF THE INVENTION

The present invention relates to an apparatus for processing a veneer such as squeezing water out of a veneer for dehydrating it and forming short splits in a veneer for tenderizing it.

A crude veneer generally has a water content ranging from 30 percent to 200 percent and needs some treatment to serve as a ply, for example. One implementation available for dehydration of crude veneers is mechanical drying which squeezes out water by compression, as proposed in Japanese Unexamined Patent Publication (Kokai) No. 48-49905 and others. The prior art mechanical drying system uses compressing members such as rolls which act on the whole surfaces of a crude veneer to squeeze water thereoutof. The problem with this system is that although the processing may consume far less energy and far shorter period of time than an evaporation type drying system which uses a dryer, a veneer is inevitably subjected to compressive deformation over the entire surfaces thereof and, thereby, plastically deformed in a thicknesswise direction thereof and/or broken down. Specifically, to remove a greater amount of water, a greater amount of compressive deformation of a veneer is required. Such compressive deformation would impose excessive loads on the tissues of veneers considerably affecting the quality of a product made of the veneers, e.g. plywood. For this reason, it has been customary to control the amount of deformation to below a relatively small one sacrificing the amount of water which is removable from veneers.

Another prior art dehydration system for veneers is implemented with rolls each having tooth-like projections on its peripheral surface, as disclosed in Japanese Patent Publication Nos. 52-9712 and 56-32547. However, even such a system cannot constitute a solution to the above-discussed problem. Specifically, the tooth-like projections, or teeth, on each roll are directed to eliminating irregular splits otherwise formed in veneers during compression, the compression still being performed bythe roll peripheries other than the teeth. The distance between the peripheries of the rolls except for the teeth, or bottom lands, is not greater than about 30–60 percent of the thickness of a veneer, so that the rolls cause a veneer to undergo plastic deformation over the entire surfaces against which the rolls are abutted.

Meanwhile, there has been proposed a tenderizing apparatus in which a veneer is passed through, for example, a pair of rolls at least one of which is provided with narrow compressing elements, as shown and described in Japanese Patent Publication No. 49-39808. The rolls compress a veneer to deform and thereby form splits in it. This type of tenderizing apparatus cannot form splits in a veneer unless it applies a sufficient degree of pressure thereto so that, where the surfaces which act on a veneer are substantially flat such as those of the above-mentioned compressing elements, the required compressing force is considerable. The apparatus therefore cannot avoid a complicated and expensive construction. Another disadvantage is that since the gap between the compressing elements and the other roll or other compressing elements cannot be reduced beyond a value approximate to zero at maximum, the expected tenderizing effect is unattainable depending upon the physical properties of a veneer.

An apparatus for processing a veneer of the present invention comprises a pair of rotary bodies each being provided on an outer periphery thereof a number of teeth edge lines of which extend each in a direction that intersects an intended direction of rotation of the rotary body. The rotary bodies are located such that the teeth thereon are aligned with each other in a predetermined position where the veneer is inserted. The edge of each of the teeth is indented along the edge line to have alternating projections and recesses. Tips of the projections of the teeth on one rotary body and those of the projections of the rotary body assume a predetermined relative position in the predetermined position for veneer insertion. The apparatus also comprises a resilient material which fills the recesses of the teeth which neighbor each other on each of the rotary bodies.

The words "edge line" of a tooth repeatedly mentioned herein generally refers to a one which is parallel to an axis of rotation, a one which intersects an axis of rotation at a predetermined angle, a one which spirally intersects an axis of rotation at a predetermined angle, a one which extends in a zig-zag configuration along an axis of rotation, etc. The word "tooth" on the other hand covers a one whose section in a plane perpendicular to the edge line, or profile, is triangular and a one the edge of which is not sharpened and, instead, provided with a tooth crest.

In accordance with the present invention, a dehydrating effect is predominant when a veneer is inserted into the apparatus in such an orientation that fibers thereof extend substantially parallel to the direction of insertion, and a tenderizing effect when it is inserted in such an orientation that the fibers extend substantially perpendicular to the direction of insertion. Although such has been proved by experiments, the apparatus in the instant specification is positively referred to as a veneer processing apparatus because which one of the two different effects is to be chosen depends upon the person.

Further, that the projections and recesses of one rotary body interlock with those of the other rotary body implies a condition wherein the projections protrude into the recesses. Meanwhile, that the projections on the facing rotary bodies are spaced from each other by an amount which is smaller than the thickness of a veneer implies a condition wherein the projections on the rotary bodies, more precisely the tip cylinders each passing through the tips of the projections of the rotary body, are aligned with each other or spaced apart from each other by an amount which is smaller than the thickness of a veneer. Therefore, the situation concerned with the spacing covers both a case wherein the projections of the two rotary bodies are aligned with each other, and a case wherein they are deviated from each other by half a pitch such that the projections of one rotary body are aligned with the recesses of the other rotary body.

SUMMARY OF THE INVENTION

It is an object of the present invention to provide a veneer processing apparatus which eliminates the need for great compressing forces.

It is another object of the present invention to provide a veneer processing apparatus which is simple in construction and cost-effective.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

While the veneer processing apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
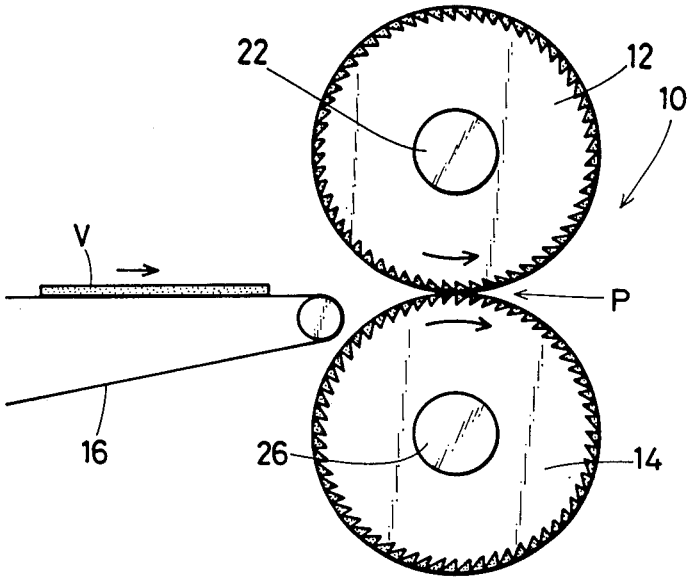
FIG. 1 is a front view of an essential part of a veneer processing apparatus embodying the present invention.

Referring to FIG. 1 of the drawings, an apparatus embodying the present invention is shown and generally designated by the reference numeral 10. As shown, the apparatus 10 comprises a pair of rotary bodies in a form of rolls 12 and 14 which are driven by gears or like drive mechanisms (not shown) as indicated by arrows with peripheral speeds thereof matched to each other. A conveyor 16 is located ahead of the apparatus 10 in order to feed a crude veneer 18 toward a predetermined position P for veneer insertion as indicated by an arrow A.

Figure 2:
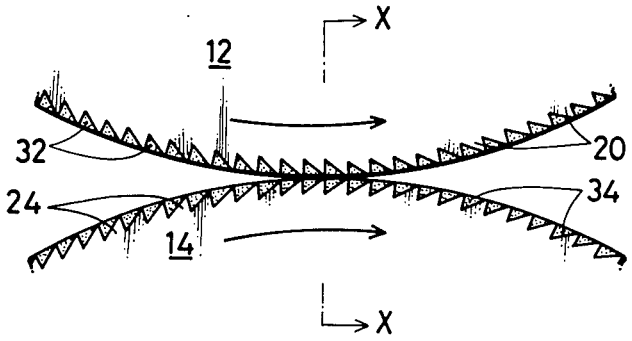
FIG. 2 is an enlarged view of a veneer veneer inserting section which is included in the apparatus of FIG. 1.

As shown in an enlarged scaled in FIG. 2, the roll 12 is provided with a number of teeth 20 at equally spaced locations along the circumference. For example, where the diameter of the roll 12 is 295 millimeters, the spacing, or pitch, between nearby teeth 20 may be 5 millimeters. Each of the teeth 20 has an edge line extending parallel to a shaft 22, on which the roll 12 is mounted, and has a right-triangular profile with a vertical angle of 45 degrees which is perpendicular to the edge line. Likewise, the roll 14 is provided with a number of teeth 24 which are identical in shape and arrangement with the teeth 20 of the roll 12. A shaft on which the roll 14 is mounted is designated by the reference numeral 26.

Figure 3:
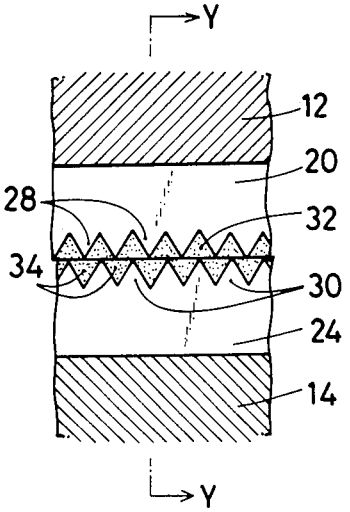
FIG. 3 is a section along line X—X of FIG. 2.

The edges of the teeth 20 and 22 are each indented in a zig-zag configuration along the edge line thereof. In this particular embodiment, as shown in FIG. 3, the teeth 20 and 22 are indented to have respectively projections 28 and 30 each having an equilateral-triangular shape with a vertical angle of 60 degrees. The pitches of the projections 28 and 30 are commonly selected to be 3 millimeters and deviated from each other by half a pitch. Therefore, where the rolls 12 and 14 are located to face each other, the projections 28 and 30 are held in an interlockable relation to the recesses, not designated, of the opposite teeth 22 and 20. It is needless, however, that the edges of all the teeth 20 and 24 be provided with such projections in the same or uniform configuration. For example, the projections of nearby teeth may be arranged with their pitches deviated from each other or even the pitches themselves may be changed. Further, two identical rolls each being provided with projections at constant pitches throughout the teeth may be prepared and juxtaposed with half a pitch of positional deviation from each other. The gist is that when a pair of rolls are located to face each other, the projections of their teeth substantially interlock with the recesses of the opposite teeth.

The recesses between nearby teeth 20 and those between nearby teeth 24 are filled with elastic materials 32 and 34, respectively. The elastic materials 32 and 34 may desirably comprise mono-cellular sponge, preferably a one having a hardness of 60 degrees.

As shown in FIG. 3, the rolls 12 and 14 each having the above structure are located to face each other in such a manner that their indented edges are in an interlockable relationship and, as viewed in a section perpendicular to the axes of the rolls 12 and 14, the projections 28 and 30 are lined up at the position P, that is, the distance between the tips of the projections 28 and 30 is zero.

The apparatus 10 having the above construction is operable to tenderize a veneer as follows.

Figure 4:
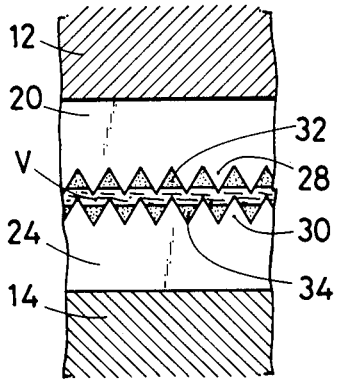
FIG. 4 is a view similar to FIG. 3, showing a veneer which is inserted into the veneer inserting section in such an orientation that fibers thereof extend substantially perpendicular to the intended direction of insertion.

A crude veneer V is laid on the conveyor 16 in such an orientation that fibers thereof extend substantially perpendicular to the intended direction of veneer insertion A. As the conveyor 16 is driven to feed the veneer V in the direction A, the veneer V is sequentially inserted into between the rolls 10 and 12 which are rotating as indicated by the arrows. Then, as shown in FIG. 4, the projections 28 and 30 pierce into the the veneer V compressing the elastic materials, or fillers, 34 and 32 of the rolls 14 and 12, respectively. As a result, a great number of short splits are formed in the veneer 18 starting at the pierced points of the veneer V.

The veneer V tends to be released from the rolls at the downstream or outlet side of the rolls 12 and 14 with respect to the direction A, and such a tendency of the veneer is enhanced by the elastic fillers 34 and 32. Specifically, the fillers 32 and 34 made of sponge and filling the spaces between the projections 28 and 30, respectively, serve to force the veneer V away from their associated rolls 12 and 14 by repulsive forces so as to allow the projections 28 and 30 to readily draw themselves out of the veneer V. Otherwise, the projections 28 and 30 are liable to entrain the veneer V to stop up the veneer transport path or to break the veneer, as would be the case with a prior art tenderizing apparatus. In this manner, the apparatus 10 is capable of forming short splits in the veneer V at the same intervals as the projections 20 and 24 which are distributed at equally spaced locations along the circumference of the rolls 12 and 14.

Another function which may be fulfilled by the apparatus 10 is dehydrating the veneer V as will be described next.

Figure 5:
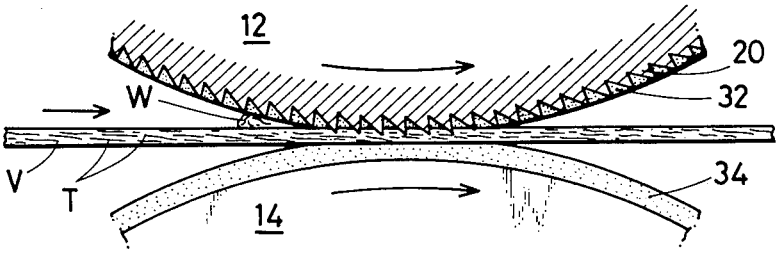
FIG. 5 is a section along line Y—Y of FIG. 3, showing a veneer which is inserted in such an orientation that fibers thereof extend substantially parallel to the intended direction of insertion.

The veneer V is inserted into the position P between the rolls 12 and 14 in such an orientation that its fibers extend substantially parallel to the direction A, as shown in FIG. 5. The veneer V is locally subjected to compressive deformation at its opposite surfaces by the teeth 20 and 24, as also shown in FIG. 5. As a result, tracheae, tracheids and other tubulous tissues T of the veneer V each extending substantially in the direction A are deformed at those portions of the veneer V against which the teeth 20 and 24 are abutted as well as before and after those portions. This forces water in the tissues T toward the inlet side and the outlet side, with respect to the direction A, away from the position P. Then, the fillers 32 and 34 on the rolls 12 and 14 slightly compress the veneer V from opposite sides and, subsequently, the teeth 20 and 24 adjacent to and subsequent to those portions of the fillers 32 and 34 which have compressed the veneer V cause the veneer V to undergo local compressive deformation at opposite surfaces. Water squeezed out of the veneer V by the teeth as stated above is trapped by the fillers 32 and 34. In addition, since the distance between the nearby teeth is sufficiently short, that part of the water which has been forced toward the inside side by the downstream tooth is forced farther toward the same side by the upstream tooth. Such a procedure is repeated with the result that the water is sequentially pressed toward the inlet side along the tissues T of the veneer V.

From the probability stantpoint, it is rare that the tubulous tissues T of the veneer V extend exactly parallel to the opposite major surfaces of the veneer V; usually their opposite ends are open to the outside at both veneer surfaces. Consequently, the water moved as discussed above along the tissues T is squeezed out at opposite veneer surfaces. Such an occurrence also applies to that part of the water which is forced by the teeth toward the outlet side of the rolls 12 and 14. At either side of the rolls 12 and 14, the water pressed out to the lower surface of the veneer V is let fall by gravity, while the water W pressed out to the upper surface collects itself at the inlet side of the rolls 12 and 14 to be let fall by gravity at both sides and trailing end of the veneer V. For further effective removal of the water W on the veneer upper surface, use may be made of a forcible implementation such as blowing compressed air or suction by vacuum.

Furthermore, in this particular embodiment, because each of the teeth 20 and 24 has a right-angled trianglular profile which is inclined at the inlet side, displacement of the squeezed water toward the inlet side is even more effectively promoted.

Generally, the tubulous tissues T of a veneer V are inclined relative to the surfaces of the veneer V and release water by an amount which differs from the upper surface to the lower surface. For more effective dehydration, therefore, the veneer V may be passed through the rolls 12 and 14 twice or more while being turned over each time.

Figure 6:
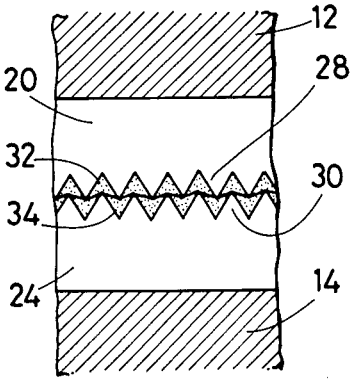
FIGS. 6 and 7 are sections each taken along line X—X of Fig. 2 to show a modified configuration of projections which are formed at the edge of each tooth.

In the embodiment of FIGS. 1–5, the rolls 12 and 14 are arranged such that their projections 28 and 30 substantially do not interlock with each other, i.e., such that the distance between the edge line connecting the tips of the projections 28 and that connecting the tips of the projections 30 is zero. Alternatively, where the veneer V to be processed by the apparatus is relatively hard and/or it is desired to remove a greater amount of water thereoutof, the rolls 12 and 14 may be positioned closer to each other. Specifically, as shown in FIG. 6, the relative position of the rolls 12 and 14 may be such that the projections 28 and 30 respectively substantially interlock with the recesses of the facing teeth 20 and 24. In this alternative arrangement, the projections 28 and 30 may penetrate deeper into the veneer V to positively form splits therein or to remove a greater amount of water from the veneer V.

Figure 7:
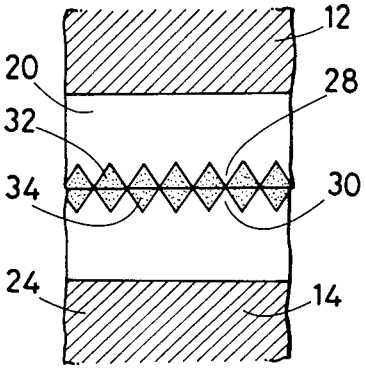

As shown in FIG. 7, the rolls 12 and 14 may be so located or configured as to have the projections 28 and 30 being aligned one-to-one with each other.

It will be seen from the above various modifications that the relative position of the rolls 12 and 14 is open to choice insofar as the distance between the tips of the projectins 28 and 30 is smaller than the thickness of the veneer V.

Figure 8:
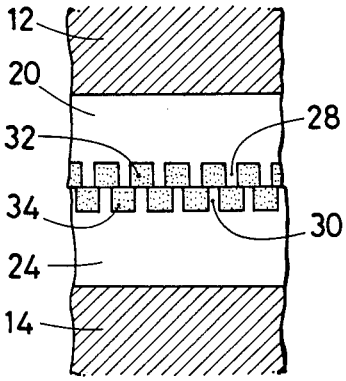
FIG. 8 is a section along line X—X of FIG. 2 showing projections which are arranged in a comb-like configuration.

Further, as shown in FIG. 8, the teeth 20 and 24 may each be indented to have a configuration which resembles the teeth of a comb. Stated another way, the configuration of the projections 28 and 30, too, may be modified as desired so long as the expected function as discussed above is preserved.

Figure 9:
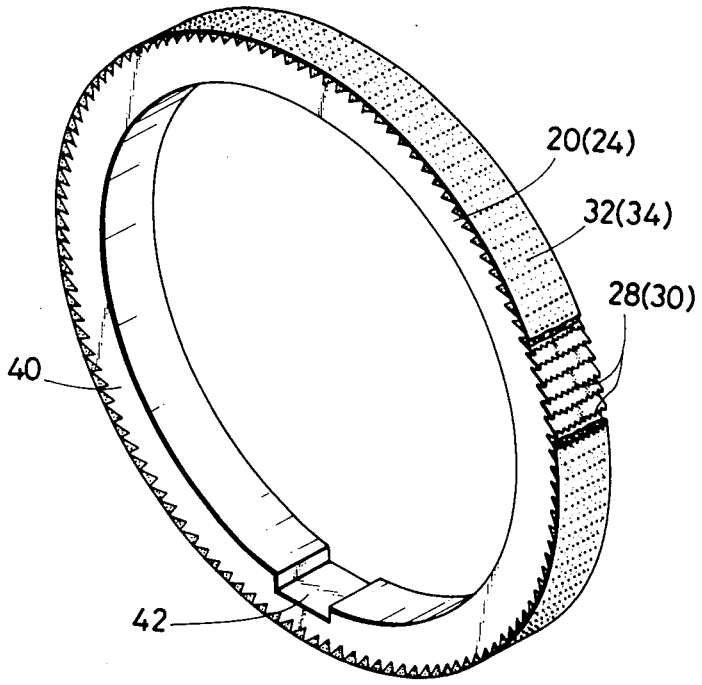
FIG. 9 is a perspective view of an annular roll element.

While in the embodiment of FIGS. 1 to 5 each of the rolls 12 and 14 is shown and described as being mounted integrally or substantially integrally on the associated shaft 22 or 26, such is only illustrative and may be replaced with an assembly of a plurality of annular roll elements, or rings, each having a relatively small axial width as will be described with reference to FIG. 9. In FIG. 9, the same or similar structural parts and elements as those of FIGS. 1–5 are designated by like reference numerals.

Referring to FIG. 9, a roll element, or ring, 40 which constitutes any of the rolls 12 and 14 together with other similar roll elements is shown. In this particular embodiment, the ring 40 has an axial width of substantially 26 millimeters and a diameter of substantially 295 millimeters. The ring 40 is provided with the projections 20 (or 24) on the outer peripheral surface thereof in the previously stated manner. Again, the recesses between the nearby projections 20 (or 24) on the ring 40 are filled with the elastic filler 32 (or 34) made of sponge. The ring 40 is formed with an axial groove 42 in an inner peripheral surface thereof. A plurality of such rings 40 may be mounted coaxially on a rotary shaft, not shown, and securely locked to the latter by keys which may be seated in the grooves 42, completing a ring assembly which is essentially the same as the roll 12 (or 14).

An advantage attainable with the assembly of separate roll elements 40 shown in FIG. 9 is that when the tips of any of the roll elements 40 are damaged by an object unexpectedly introduced into the apparatus 10, only the damaged roll element 40 needs to be replaced with another and such is remarkably cost-saving. Further, since the relative position of the nearby roll elements 40 in each assembly is suitably variable such that, for example, teeth 20 (or 24) are deviated by half a pitch from each other along the axis of the assembly, a roll which matches with particular physical properties of a veneer is achievable.

In any of the embodiment and modifications thereto as discussed above, the roll 12, 14 and 40 may be made of plastics in order to cut down the material cost. Use of a molding of plastic would further enhance the cost reduction.

Figure 10:
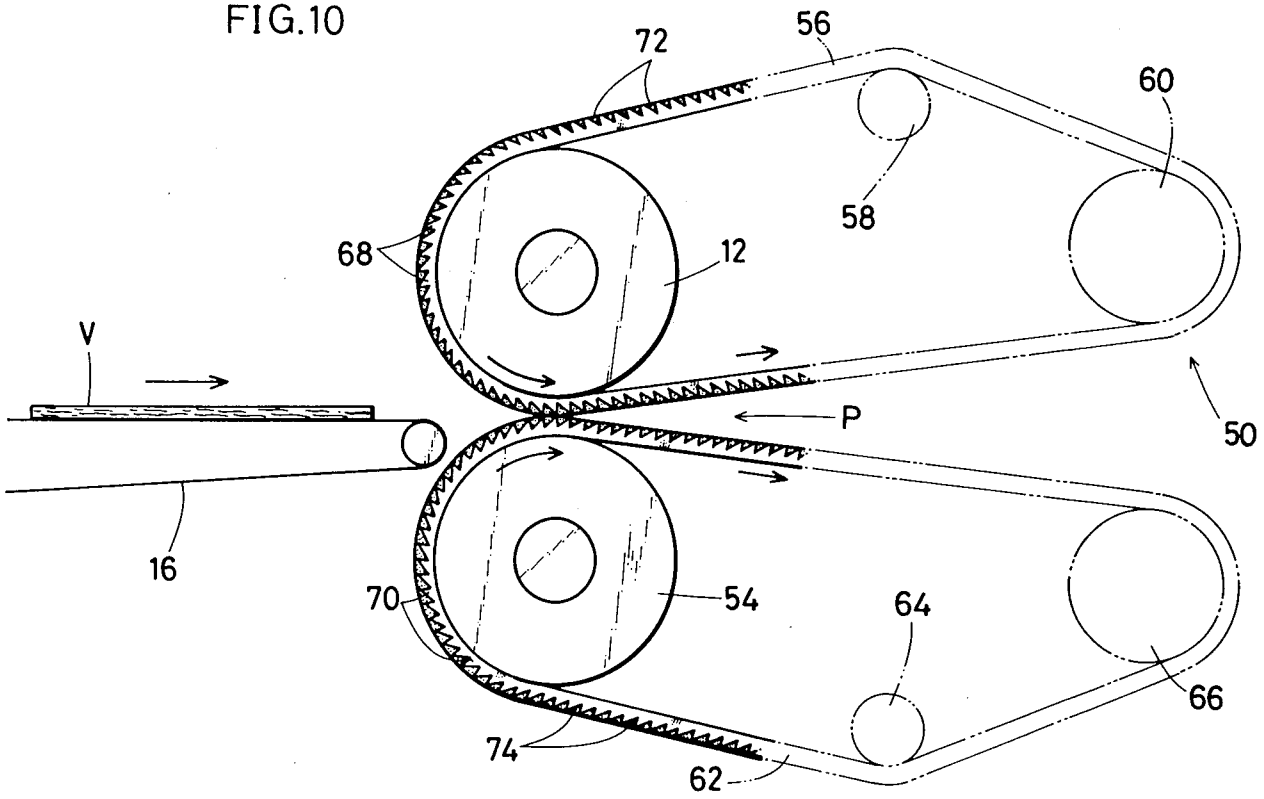
FIG. 10 is a front view of an essential part of a veneer processing apparatus in accordance with another embodiment of the present invention.

Referring to FIG. 10, another embodiment of the veneer processing apparatus of the present invention is shown and generally designated by the reference numeral 50. The apparatus 50 includes pressure rollers 52 and 54 which are each driven for rotation as indicated by an arrow by a drive mechanism, not shown. An endless belt made of steel 56 is passed over the drive roller 52 and other rollers 58 and 60. Likewise, an endless steel belt 62 is passed over the drive roller 54 and other rollers 64 and 66. Teeth 68 and 70 are respectively formed on the outer peripheries of the belts 56 and 62 in the same manner as the teeth 20 and 24 of the rolls 12 and 14 of the first embodiment. Each of the teeth 68 and 70 is notched to have projections and recesses along the edge line as in any of the foregoing embodiment and its modifications. Elastic fillers 72 and 74 made of sponge are respectively mounted on the belts 56 and 62 so as to fill up the gaps between the teeth. The operation of the apparatus 50 will be understood by analogy from the operation of the apparatus 10 and, therefore, will not be described to avoid redundancy.

Figure 13:
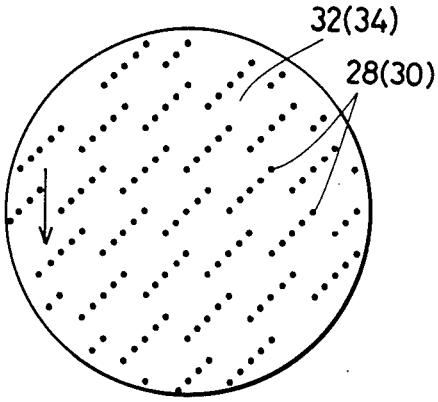
FIGS. 11 to 14 are views each showing a specific arrangement of teeth.
Figure 11:
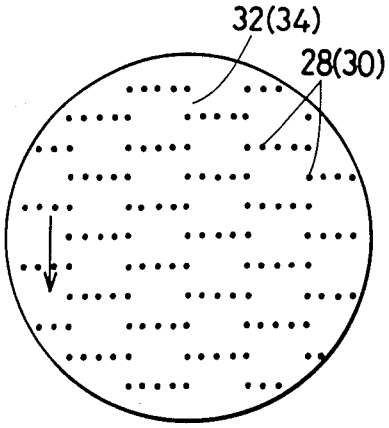
Figure 14:
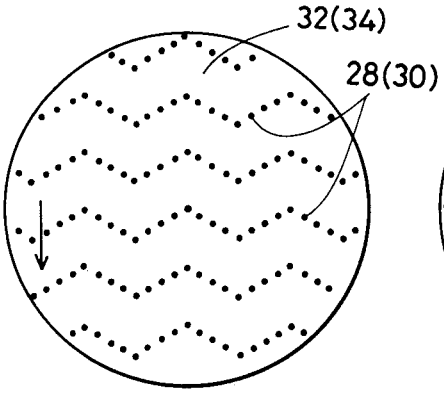
Figure 12:
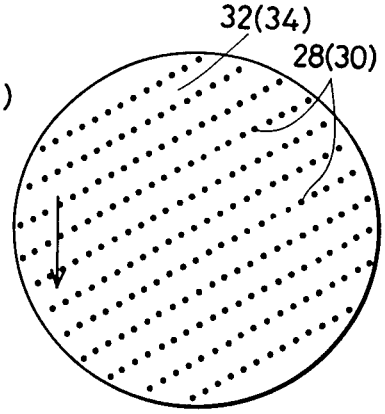

Referring to FIGS. 11–14, there are shown some examples of the arrangement of any of the teeth 20, 24, 72 and 74. In FIG. 11, teeth each having an edge line which extends parallel to the axis of rotation are arranged sequentially staggered half a pitch each. In FIG. 12, teeth each having an edge line which intersects the axis of rotation at an angle of substantially 30 degrees are positioned at equally spaced locations in the direction of rotation. In FIG. 13, teeth each having an edge line which intersects the axis of rotation at an angle of substantially 45 degrees are arranged in a staggered relation along the axis of rotation. Further, in FIG. 14, teeth each having an edge line which extends in a zigzag configuration along the axis of rotation are arranged at equally spaced locations in the direction of rotation. In FIGS. 11 to 14, the reference numerals 28 (30) designate the projections formed at the edges of the teeth, 32 and 34 designate the elastic fillers made of sponge, and arrows indicate the direction of rotation of the rollers.

Where the teeth on each roller are formed discontinuously along the axis of rotation, as shown in FIGS. 11 and 13 by way of example, the rotary bodies may advantageously implemented with an assembly of the separate rings 40 as shown in FIG. 9 in order to cut down the cost.

As described above in relation to preferred embodiments, the rotary bodies applicable to the apparatus of the present invention may take the form of rolls or that of endless belts. The configuration of the teeth formed on the rotary bodies is open to choice. Also open to choice is the configuration of the indented portion which is provided at the edge of each tooth. While the rotary bodies may be provided with any desired diameter, experiments proved that rolls having a diameter of 75 to 150 millimeters are optimum. Further, one of the paired rolls may be provided with a different diameter from the other, in which case the peripheral speeds of the two rolls should only be matched to each other by a gearing or the like.

In summary, it will be seen that the present invention provides a veneer processing apparatus in which teeth provided on rolls smoothly penetrate into a veneer eliminating the need for great compressive forces otherwise required to process a veneer. The apparatus is therefore simple in construction and cost-effective. Furthermore, since a veneer is compressed only by the teeth up to the range of plasticity or breakage, it is plastically deformed or broken only at those limited spots which are effected by the teeth, plus some narrow inlet and outlet regions adjacent thereto. Stated another way, the thickness of the veneer as a whole is little reduced because a major part of the veneer against which elastic fillers on the rolls abut undergoes deformation within the range of elasticity only. Such a veneer is comparable in thickness and strength with a veneer which is processed by the ordinary evaporation drying technique, when subjected to heat and compression as may occur later at a bonding stage. The local compressive deformation offers another advantage that a veneer with knots can be dehydrated without having the knots removed, thereby effectively eliminating various troubles due to removal of knots. The apparatus therefore is capable of desirably coping even with knotty timber.

Various modifications will become possible for those skilled in the art after receiving the teachings of the present disclosure without departing from the scope thereof. For example, the unique concept of the present invention may be applied only to one of a pair of rotary members while implementing the other rotary body with a roll made of hard resin or steel and provided with a flat pressurizing surface or a belt made of steel.

What is claimed is:

1. An apparatus for processing a veneer, comprising:

a pair of rotary bodies each being provided on an outer periphery thereof a number of teeth, edge lines of which extend each in a direction that intersects an intended direction of rotation of said rotary body, said rotary bodies being located such that said teeth on said rotary bodies are aligned with each other in a predetermined position where the veneer is inserted;

an edge of each of said teeth being indented along the edge line to have alternating projections and recesses, tips of said projections of said teeth on one of said rotary bodies and tips of said projections of said teeth on the other rotary body assuming a predetermined relative position in said predetermined position for veneer insertion and the tips of said projections being adapted to extend into the surface of an inserted veneer sheet; and a resilient material filling said recesses of said teeth which neighbor each other on each of said rotary bodies.

2. An apparatus as claimed in claim 1, wherein said predetermined relative position is such that said projections and recesses of said teeth on said one rotary body are respectively substantially interlocked with said recesses and projections of said other rotary body.

3. An apparatus as claimed in claim 1, wherein said predetermined relative position is such that the tips of said projections of said teeth on said one rotary body are spaced from the tips of said projections of said teeth on said other rotary body by an amount which is smaller than a thickness of the veneer.

4. An apparatus as claimed in claim 1, wherein said rotary bodies comprise rolls.

5. An apparatus as claimed in claim 1, wherein each of said rotary bodies comprises a rotary shaft and a plurality of annular rolls which are coaxially mounted on said rotary shaft.

6. An apparatus as claimed in claim 1, wherein each of said rotary bodies comprises an endless belt which is passed over a plurality of rollers.

7. An apparatus as claimed in claim 1, wherein said projections and recesses of each of said teeth are formed in a zig-zag configuration.

8. An apparatus as claimed in claim 1, wherein said projections and recesses of each of said teeth are formed in a configuration of teeth of a comb.

9. An apparatus as claimed in claim 1, wherein said elastic material comprises sponge.

* * * * *

UNITED STATES PATENT AND TRADEMARK OFFICE

CERTIFICATE OF CORRECTION

PATENT NO. : 4,718,338

DATED : January 12, 1988

INVENTOR(S) : Yoshinori Koba

It is certified that error appears in the above-identified patent and that said Letters Patent is hereby corrected as shown below:

Column 1, line 47, replace "bythe" with --by the--.

Column 5, line 34, replace "stantpoint" with --standpoint--.

Column 7, line 45, after "the rotary bodies may" add --be--.

In the Abstract, line 11, replace "teeth" with --tooth--.

Signed and Sealed this

Twenty-seventh Day of June, 1989

*Attest:*

*Attesting Officer*

DONALD J. QUIGG

*Commissioner of Patents and Trademarks*